United States Patent [19]

Solomon

[11] 4,422,768

[45] Dec. 27, 1983

[54] PAINT CAN SHAKER

[75] Inventor: Donald F. Solomon, Costa Mesa, Calif.

[73] Assignee: Roy Brodshy, Santa Monica, Calif.

[21] Appl. No.: 360,350

[22] Filed: Mar. 22, 1982

[51] Int. Cl.[3] ..... B01F 11/00

[52] U.S. Cl. ..... 366/110; 366/111; 366/114; 366/209; 366/216; 366/239; 366/605

[58] Field of Search ..... 366/110–112, 366/114, 115, 116, 124–126, 128, 202, 210, 211, 216, 217, 237, 239, 605; 74/61, 87

[56] References Cited

U.S. PATENT DOCUMENTS

| | | | |
|---|---|---|---|
| 2,247,978 | 7/1941 | Van Arkel | 366/110 |
| 3,388,895 | 6/1968 | Ogren et al. | 366/605 |
| 3,415,495 | 12/1968 | Grubelic | 366/305 |
| 4,265,548 | 5/1981 | Hall | 366/605 |

*Primary Examiner*—Timothy F. Simone

*Attorney, Agent, or Firm*—Gordon L. Peterson

[57] ABSTRACT

A paint can shaker including a frame adapted to be supported on a supporting surface and a paint can carrier mounted on the frame and adapted to receive and support a paint can. The frame includes springs acting between the frame and a supporting surface to enable the carrier to undergo rolling vibratory motion relative to the supporting surface. The paint can is supported on the carrier by first and second jaws, one of which is movable on the carrier. A motor is mounted on the carrier and drives an unbalanced member to impart vibratory motion to the carrier.

10 Claims, 6 Drawing Figures

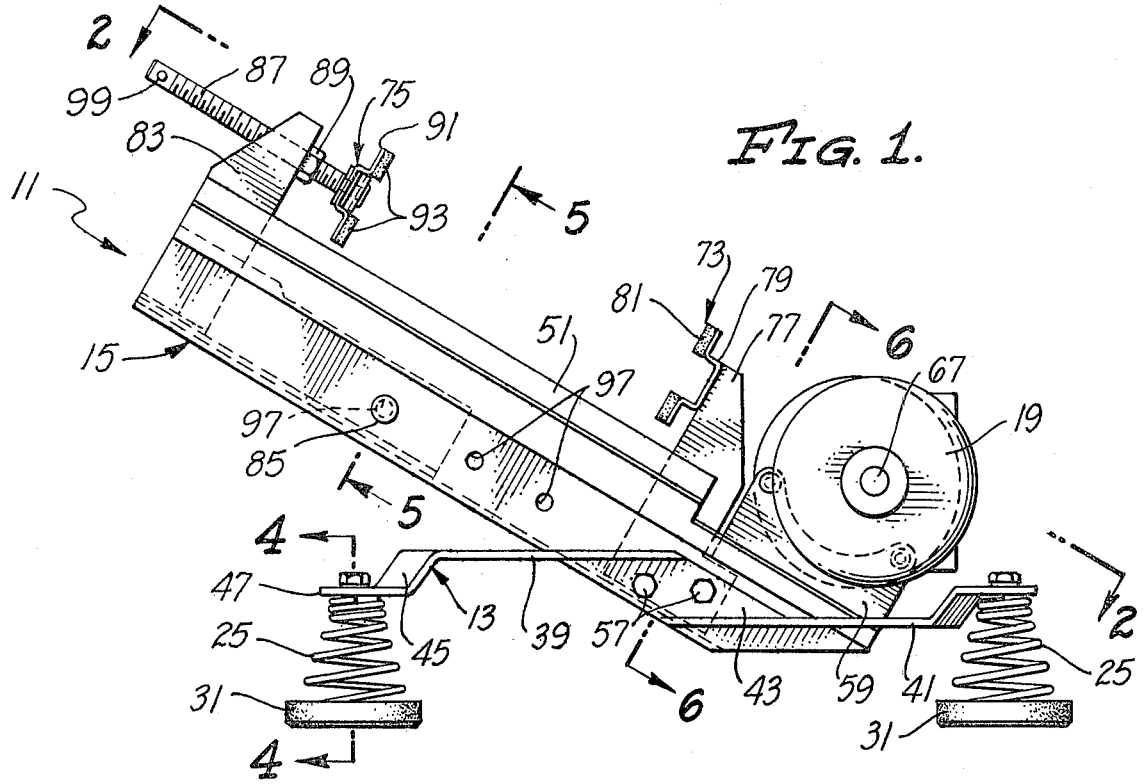
FIG. 1.
FIG. 2.
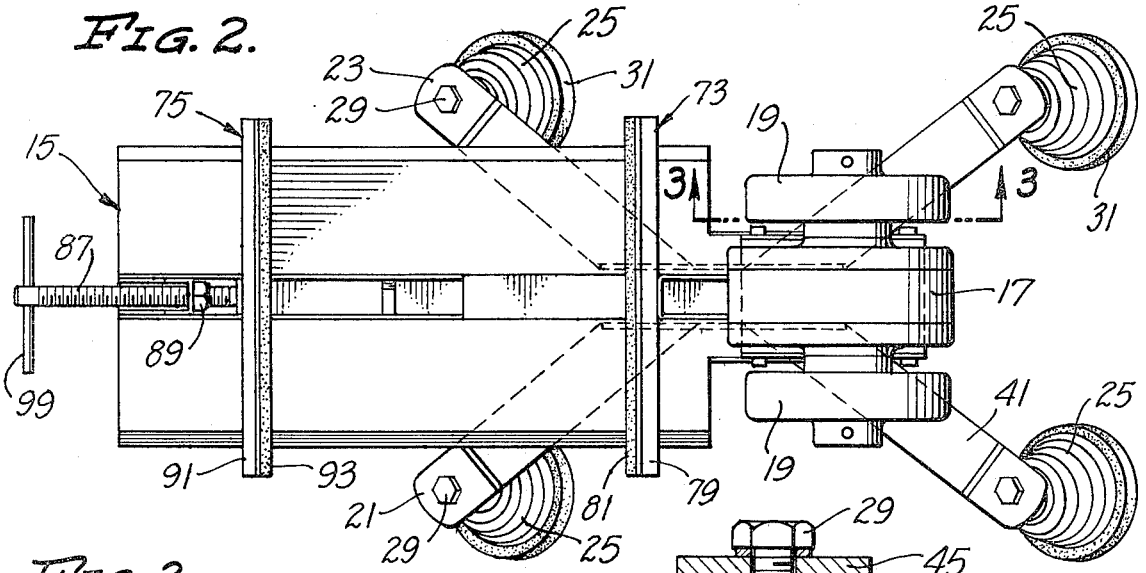
FIG. 3.
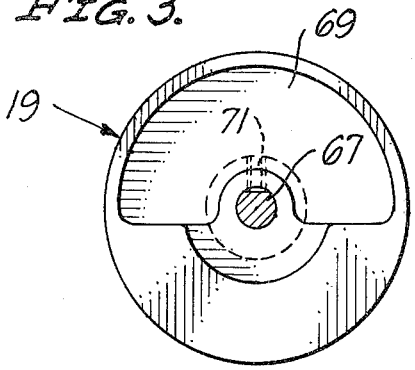
FIG. 4.
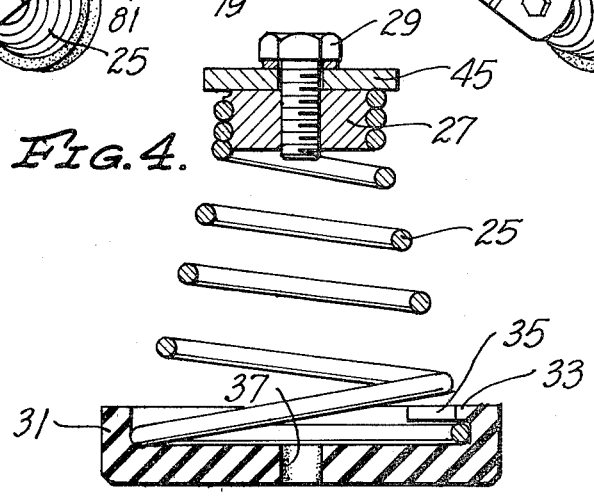

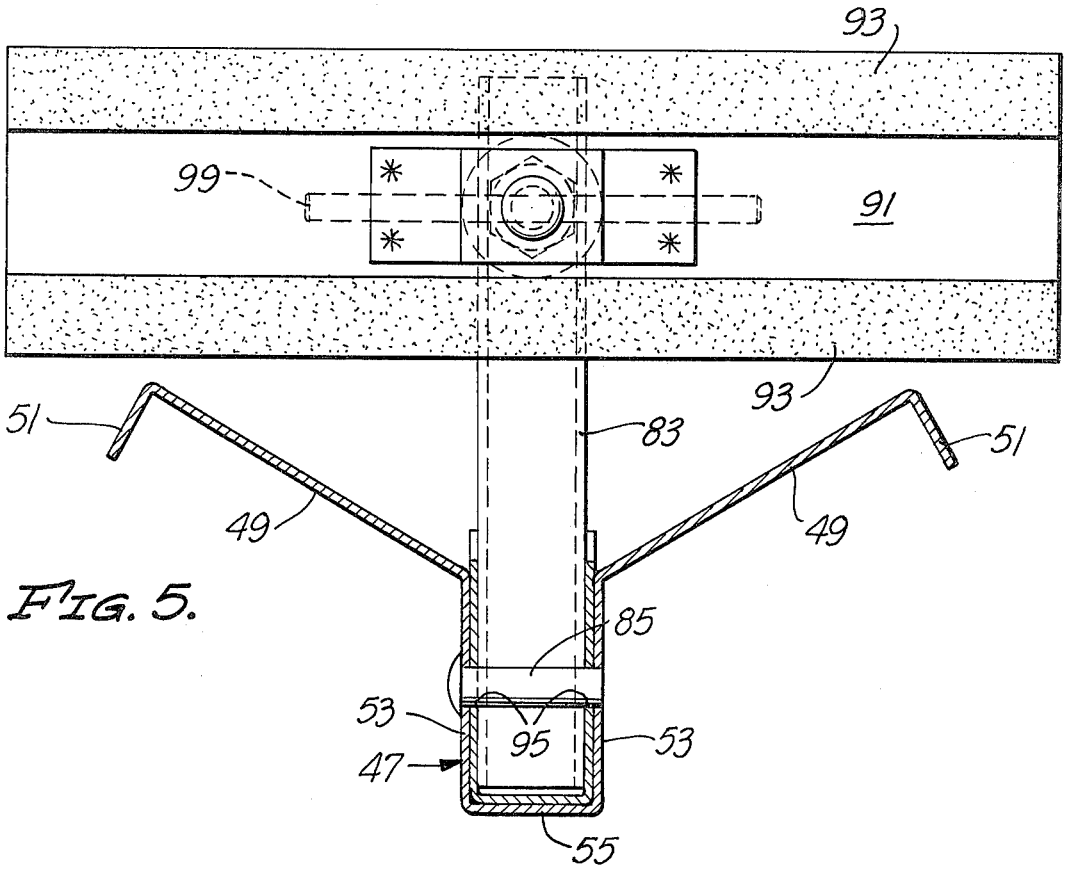
FIG. 5.
FIG. 6.
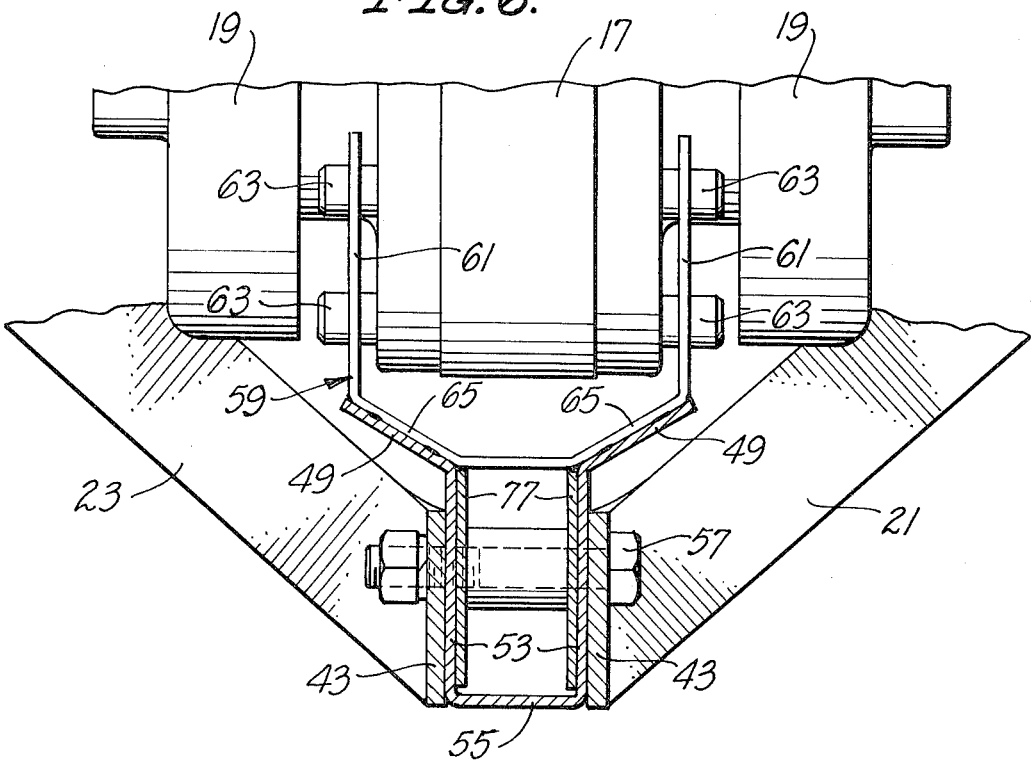

PAINT CAN SHAKER

BACKGROUND OF THE INVENTION

The mixing of various compositions, such as paint, requires vigorous shaking or agitation over a period of time. This can be accomplished with a mixing apparatus which shakes the container and its contents. There are many mixing apparatuses of this type, and two such apparatuses are shown in Sorensen U.S. Pat. No. 4,134,689 and Van Arkel U.S. Pat. No. 2,247,978.

Prior art apparatuses for shaking a paint can are generally relatively cumbersome and complex. In addition, devices of this type are not readily portable and may not provide the most desirable form of motion for thoroughly mixing the contents of the paint can.

SUMMARRY OF THE INVENTION

This invention provides a paint can shaker which provides optimum vibratory motion for mixing the contents of a container, such as a paint can. The mixing apparatus of this invention is lightweight, easily portable and relatively inexpensive. A mixing apparatus constructed in accordance with the teachings of this invention is adapted to shake containers of different masses, and it provides the desired vibratory motion while expending a minimum of input energy. Although the mixing apparatus of this invention can mix various different materials, it is particularly adapted for mixing paint.

This invention can advantageously be embodied in a mixing apparatus which comprises a paint can carrier adapted to receive and support a container, such as a paint can and means for mounting the paint can carrier on a supporting surface. The mounting means includes resilient means for enabling the carrier to undergo vibratory motion relative to the supporting surface. The paint can or other container is retained on the carrier by retaining means which includes at least first and second jaws for gripping the paint can therebetween. Vibratory motion is provided by a motor which causes the carrier to vibrate as permitted by the resilient means.

One feature of this invention is that the carrier includes a generally channel-shaped section. This provides a convenient mounting structure for mounting various components of the mixing apparatus, such as one or more of the jaws. To enable the jaws to grip containers of different sizes, at least one of the jaws is movable, and the channel conveniently enables the mounting of such jaw on the carrier for movement relative to the carrier. Also, the use of a channel-shaped section on the carrier permits the carrier to be constructed of relatively inexpensive sheet material and it strengthens the carrier.

The carrier also preferably includes diverging wing members extending outwardly of the channel-shaped section to define surfaces for at least assisting in supporting a container. In a preferred construction, the carrier supports the container so that the axis of the container defines an acute angle with the supporting surface.

The carrier mounting means can conveniently include a frame, and the resilient means can advantageously form a portion of the frame. The frame preferably includes first and second straps arranged in an X-like configuration. This provides a strong, lightweight and inexpensive main frame for the mixing apparatus. The resilient means can advantageously include springs acting between a supporting surface and the distal ends of the straps. The lower ends of the springs are received in feet which can be attached to, or detached from, the supporting surface on which the mixing apparatus rests.

Attachment of the carrier to the frame is facilitated by appropriately shaping central regions of the first and second straps and attaching such shaped regions to the channel-shaped sections of the carrier. The shaped region of the straps strengthens the straps and facilitates their attachment to the channel-shaped section.

Preferably, vibratory motion is imparted to the carrier by an inertial mass which acts on the resilient means to impart the vibratory motion. This can advantageously be provided by one or more rotatable members having a generally circular periphery and mounted for rotation about a rotational axis which is substantially coincident with the geometric axis of the rotatable member. The rotatable member is unbalanced about the rotational axis so that rotation of the rotatable member imparts vibratory motion to the carrier.

When the mixing apparatus is used as a paint can shaker, it is desirable to impart an essentially circular or elliptical motion to the lower portion of the paint can where the pigments tend to concentrate. With the mixing apparatus of this invention, the rotatable members are preferably located near the lower jaw, i.e., near the lower end of the paint can when the latter is mounted on the carrier, and as a result, the lower portion of the paint can tends to move in a circular or elliptical pattern to achieve the maximum beneficial mixing.

The invention, together with additional features and advantages thereof, may best be understood by reference to the following description taken in connection with the accompanying illustrative drawings.

BRIEF DESCRIPTION OF THE DRAWING

FIG. 1 is a side elevational view of a paint can shaker constructed in accordance with the teachings of this invention.

FIG. 2 is a view taken generally along line 2—2 of FIG. 1.

FIG. 3 is a sectional view taken generally along line 3—3 of FIG. 2.

FIGS. 4–6 are enlarged sectional views taken generally along lines 4—4, 5—5, and 6—6, respectively, of FIG. 1.

DESCRIPTION OF THE PREFERRED EMBODIMENT

FIGS. 1 and 2 show a mixing apparatus in the form of a paint can shaker 11 which generally comprises a frame 13, a paint can carrier 15, a motor 17 and unbalanced rotatable members 19. In the embodiment illustrated, the frame 13 comprises metal straps 21 and 23 arranged in an X-like configuration and conical coil compression springs 25 coupled to the distal ends of the straps in any suitable manner, such as by an externally, helically grooved nut 27 (FIG. 4) mounted on each distal end of the straps by a screw 29. With this construction, the upper ends of each of the springs 25 can be threaded onto the nuts 27 by using the external helical groove on the nut.

The frame 13 also includes generally cup-shaped feet 31 for receiving a lower end of each of the springs 25 and for being retained therein in any suitable manner, such as by a bayonnet-type interlock with includes a flange 33 and a groove 35 spaced circumferentially from the flange. Each of the feet 31 has a central opening 37 to enable the feet to be attached to a supporting surface by a screw or other threaded fastener. The springs 25 define resilient means which enable the carrier to undergo vibratory motion as described more particularly hereinbelow.

The straps 21 and 23 are identical and are formed of metal bent to the desired shape. The strap 21 comprises legs 39 and 41 (FIG. 1) joined by a web 43, with the web 43 and the adjacent portions of the legs 39 forming a channel of substantial strength. The strength of each of the straps 21 and 23 is further increased by bending of the distal end portions of each of the straps to define webs 45 and tabs 47 to which the nuts 27 are attached by the screws 29.

The carrier 15 includes a channel-shaped section 47 (FIG. 5), diverging wing members 49 and side rails or flanges 51 which do not extend for the full length of the carrier 15. The carrier 15 is preferably integrally constructed from suitable sheet metal. The channel-shaped section 47 preferably includes spaced, parallel legs 53 integrally connected by a web 55 as shown in FIG. 5. In the embodiment illustrated, the wing members 49 are integrally joined to the outer ends of the legs 53 and terminate in the flanges 51.

The carrier 15 is mounted on the frame 13 by threaded fasteners 57 which extend through the webs 43 of the straps 21 and 23 and the legs 53. The carrier 15 extends upwardly from the frame 13 to form an inclined bed for a container.

The motor 17 is preferably an air motor and is mounted on the carrier 15. In the embodiment illustrated, the motor support 59 (FIG. 6) is generally channel-shaped and has parallel legs 61 attached to the motor 17 by fasteners 63 and a web 65 attached to the diverging wing members 49 in any suitable manner, such as welding.

In the embodiment illustrated, the rotatable members 19 are directly driven by the motor 17 and are positioned on the opposite sides of the motor. Each of the rotatable members 19 is dynamically unbalanced, and this is preferably accomplished by employing rotatable members having circular peripheries as shown in FIG. 3 which are mounted for rotation about the axis of a drive shaft 67 coupled to the motor 17. The axis of the drive shaft 67 defines both a rotational axis and a geometric axis for the rotatable members 19. The rotatable members 19 are identical and are unbalanced about their rotational axes by providing the rotatable members with a recess 69, which may be of the type shown in FIG. 3 and which covers approximately ½ of the area of the circular rotatable member. The rotatable members 19 are suitably secured to the shaft 67 to rotate therewith as by set screws 71 and the rotatable members are preferably arranged on the shaft so that, as they rotate together in synchronism, the direction of unbalance provided by both of the members 19 is always substantially the same. It should be noted that the motor 17 and the rotatable members 19 are fixedly mounted at the lower end of the carrier 15.

To retain a paint can or other container on the carrier 15, the shaker 11 includes a fixed jaw 73 adjacent the motor 17 and members 19 and a movable jaw 75 (FIG. 1) both of which are preferably mounted on the channel-shaped section 47. Specifically, the fixed jaw 73 comprises a mounting bracket 77 of sheet metal mounted on the channel-shaped section 47 by the fasteners 57 which also attach the carrier 15 to the frame 13, a transverse member 79 welded or otherwise secured to the upper end of the mounting bracket 77 and a cushion 81 of soft, resilient material bonded to the transverse member 79.

The movable jaw 75 comprises a mounting bracket 83 receivable within the channel-shaped section 47 and retained therein by a pin 85 (FIGS. 1 and 5), a screw 87 threadedly received in a nut 89 fixedly mounted on the upper end of the mounting bracket 83, a transverse member 91 attached to the inner end of the screw 87, and cushion strips 93 bonded or otherwise attached to the transverse member 91. The position of the movable jaw 75 can be changed by removing the pin 85 to align pin openings 95 (FIG. 5) of the mounting bracket 83 with a new set of aligned holes 97 of the channel-shaped section 47. Finer adjustments in the position of the movable jaw can be made by turning the screw 87 with a handle 99 to advance or retract the screw 87 within the nut 89. The transvese member 91 is mounted on the screw so that it need not rotate with the screw 87.

In use, a paint can or other container is placed on a carrier 15, and in the case of the usual cylindrical container, the container engages the diverging wing members 49. The handle 99 is then rotated to move the movable jaw 75 to clamp the opposite ends of the container tightly between the fixed jaw 73 and the movable jaw 75. The motor 17 is then started to rotate the unbalanced rotatable members 19, and this dynamic unbalance causes the carrier 15 and the straps 21 and 23 to vibrate on the springs 25. The direction of force imparted by the unbalanced rotatable members 19 is in the direction radially outwardly of the drive shaft 67 and such force vector rotates with the rotatable members 19. This tends to impart a circular or elliptical type of motion to the bottom region of the carrier 15 and hence to the container retained thereon to provide thorough mixing.

Although an exemplary embodiment of the invention has been shown and described, many changes, modifications and substitutions may be made by one having ordinary skill in the art without necessarily departing from the spirit and scope of this invention.

I claim:

1. A shaker for a container comprising:

a container carrier including a generally channel-shaped section having spaced legs joined by a web and diverging wing members extending outwardly from the legs, respectively, of the channel-shaped section to define surfaces for at least assisting in supporting the container;

means for mounting the carrier including resilient means for enabling the carrier to undergo vibratory motion;

means for retaining the container on the carrier including first and second jaws for gripping the container therebetween, at least one of the jaws being partly received in and mounted on said channel-shaped section for movement longitudinally of the channel-shaped section and being fixable in position along said channel-shaped section;

a motor;

means for mounting the motor on the channel-shaped section; and means driven by the motor for imparting vibratory motion to the carrier.

2. A shaker for a container as defined in claim 1 wherein said carrier supports the container so that the axis of the container defines an inclined bed for the container and the channel-shaped section extends longitudinally of the inclined bed.

3. A shaker for a container as defined in claim 2 wherein said second jaw is at a lower elevation than said first jaw and said driven means is adjacent said second jaw.

4. A shaker for a container as defined in claim 1 wherein said carrier mounting means includes a main frame, a plurality of feet and means for releasably attaching the main frame to the feet, and said feet have means to facilitate their attachment so that the shaker can be mounted.

5. A shaker for a container as defined in claim 4 wherein said resilient means includes a plurality of springs acting between said feet and said main frame.

6. A shaker for a container comprising:

a frame including first and second straps having distal ends and arranged in an X-like configuration;

a container carrier adapted to receive and support a container thereon;

means for mounting the carrier on the frame;

resilient means for enabling the carrier to undergo vibratory motion and including at least one spring acting against one of said distal ends;

means for retaining the container on the carrier, including first and second jaws for gripping the container therebetween, at least one of said jaws being movably mounted on said carrier;

a motor; and means driven by said motor for imparting vibratory motion to the carrier.

7. A shaker as defined in claim 6 wherein said carrier includes a generally channel-shaped section and at least one of said jaws is mounted in said channel-shaped section.

8. A shaker as defined in claim 6 wherein said carrier includes a generally channel-shaped section and said motor is mounted on the carrier.

9. A shaker as defined in claim 6 wherein said driven means includes a rotatable member having a generally circular periphery and mounted for rotation about a rotational axis which is substantially coincident with the geometric axis of the rotatable member, said rotatable member being unbalanced about said rotational axis whereby rotation of the rotatable member about said rotational axis imparts vibratory motion to the carrier.

10. A shaker as defined in claim 6 wherein said carrier includes a generally channel-shaped section and said means for mounting the carrier on the frame includes shaped regions on the straps including webs attached to the channel-shaped section, said webs strengthening the straps.

* * * * *